United States Patent [19]

Tanaka et al.

[11] Patent Number: 4,825,145

[45] Date of Patent: Apr. 25, 1989

[54] CONSTANT CURRENT CIRCUIT

[75] Inventors: Hirotoshi Tanaka, Yamanashi; Satoshi Tanaka, Kokubunji; Taizo Kinoshita, Kokubunji; Nobuo Kotera, Kokubunji; Minoru Nagata, Kodaira, all of Japan

[73] Assignee: Hitachi, Ltd., Tokyo, Japan

[21] Appl. No.: 133,914

[22] Filed: Dec. 16, 1987

[30] Foreign Application Priority Data

Jan. 14, 1987 [JP] Japan ..... 62-4830

[51] Int. Cl.[4] ..... G05F 3/24

[52] U.S. Cl. ..... 323/315; 323/316

[58] Field of Search ..... 323/311, 312, 313, 314, 323/315, 316; 307/296 R, 297, 304

[56] References Cited

U.S. PATENT DOCUMENTS

| | | | |
|---|---|---|---|
| 4,008,406 | 2/1977 | Kawagoe | 323/313 |
| 4,327,321 | 4/1982 | Suzuki et al. | 323/315 |
| 4,453,121 | 6/1984 | Noufer | 323/313 |
| 4,686,449 | 8/1987 | Jeffrey et al. | 323/312 |

*Primary Examiner*—Peter S. Wong

*Attorney, Agent, or Firm*—Antonelli, Terry & Wands

[57] ABSTRACT

A constant current circuit includes a first FET providing an input reference current flow, a second FET providing an output current flow and a non-linear impedance element connected between the drain and the gate of the first FET. By setting a parameter of the non-linear impedance element and a parameter of the first FET to have a specific relationship with each other, the output current can be maintained at a substantially definite value irrespective of relatively large variations of the input reference current.

5 Claims, 4 Drawing Sheets

CONSTANT CURRENT CIRCUIT

BACKGROUND OF THE INVENTION

The present invention relates to a constant current circuit formed to include field effect transistors in a compound semiconductor integrated circuit.

In order to realize constant current sources, a current mirror circuits have typically been utilized in the past. For instance, an example thereof wherein Si bipolar elements are used is shown at page 234 of "Analysis and Design of Analog Integrated Circuits," by Gray Meyer, Second Edition, John Wiley & Sons Inc., 1984, and an example thereof wherein Si MOS field effect transistors are used is shown at page 710 of the same literature.

FIG. 2 shows the case where the current mirror circuit is constructed of field effect transistors (hereinafter abbreviated as FETs). In FIG. 2, F21 and F22 denote FETs, R21 a linear resistance element as a load, and $V_1$ a power source. $I_{ref}$ denotes a reference current flowing through R21 and F21, and the circuit is so constructed that an output constant current I flows through F22 with said reference current used as an input current.

This constant current circuit of FIG. 2 has a defect in that the gate-source voltage $V_{gs}$ of two FETs F21 and F22 increases and also the output current I increases when the input reference current $I_{ref}$ increases beyond a prescribed value owing to the voltage fluctuation of the power source $V_1$, the nonuniformity in the resistance $R_{21}$ and the distribution of the threshold voltage of FET F21.

FIG. 3 shows a constant current circuit which was disclosed by Japanese Patent Publication No. 16463/1971. In this circuit, a linear resistance $R_{51}$ set as in the following is connected between the collector and the base of a bipolar transistor $Q_l$ on the input side:

$$(qR51/kT)=1$$

where q indicates an amount of charge of electrons, k is a Boltzmann's constant, and T - absolute temperature.

Accordingly, an increase in the base-emitter voltage $V_{BE}$ of the transistor $Q_l$ caused by an increase in the input reference current $I_{ref}$ is canceled by an increase in a voltage drop $R_{51}$ $I_{ref}$ of the linear resistance $R_{51}$, and consequently an output current I flowing through the collector of a bipolar transistor $Q_2$ on the output side remains at a substantially fixed value.

SUMMARY OF THE INVENTION

However, the studies of the inventors of the present application revealed that the known constant current circuit of FIG. 3 known publicly had the following problems.

(1) The cancellation by the linear resistance $R_{51}$ is deficient when the input reference current $I_{ref}$ is small, while it becomes over-cancellation when $I_{ref}$ is large, and thus the range of the input reference current wherein the output current I is fixed substantially is narrow.

(2) Considerations are given only to the setting of the resistance value of the linear resistance $R_{51}$ in the case when bipolar transistors are used as the basic elements for constructing the constant current circuit, and no consideration is given to the setting of the resistance value of the resistance $R_{51}$ in the case when field effect transistors are used as said basic elements.

An object of the present invention is, therefore, to furnish a constant current circuit, the basic elements of which consist of field effect transistors, and which enables the maintenance of an output current at a prescribed definite value even when an input reference current varies over a wide range.

Other objects and novel characteristics of the present invention will be apparent from the following description of embodiments.

The aforesaid object is attained by connecting an impedance element having non-linear characteristics between the gate and the drain of FET, wherein the input reference current $I_{ref}$ flows through a drain-source current channel. According to this non-linear characteristics, a voltage drop of $\alpha I_{ref}^n+\beta$ (where $n\neq 1$) occurs between both ends of said, impedance element. If the mutual conductance of the FET through the input reference current $I_{ref}$ flows is denoted by k, parameters $\alpha$, $I_{ref}$, n and k satisfy the following equation substantially.

$$I_{ref}^{n-\frac{1}{2}} = \frac{1}{2n\alpha\sqrt{K}}$$

The aforesaid impedance element carrying the non-linear characteristics operates to reduce the sensitivity to the fluctuation of an output current I flowing through the current supply source in relation to the non-uniformity in the input reference current $I_{ref}$ caused by the fluctuation of a source voltage or the like, In other words, it controls a gate voltage of the FET which makes the output current I flow so that the value of I decreases (increases) when the value of $I_{ref}$ increases (decreases). This operation enables providing a very stable constant current.

DESCRIPTION OF THE PREFERRED EMBODIMENTS

Figure 1:
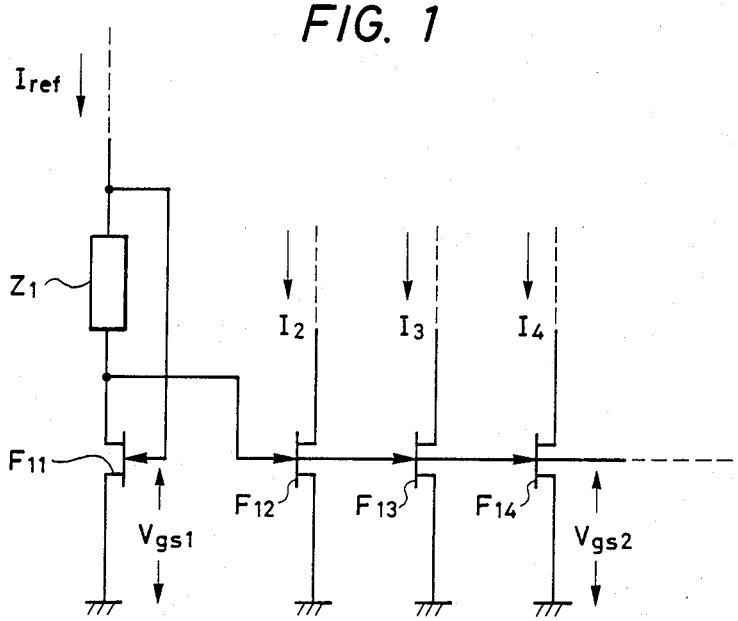
FIG. 1 is a circuit diagram of a constant current circuit according to one embodiment of the present invention.
Figure 2:
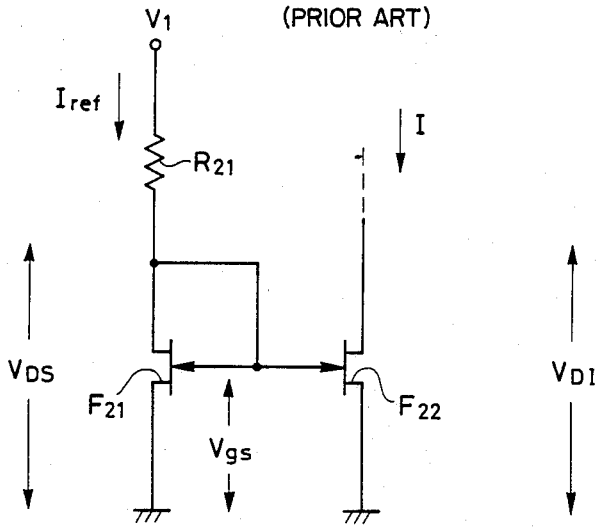
FIG. 2 (PRIOR ART)
FIGS. 2 and 3 are circuit diagrams of constant current circuits known publicly heretofore.
Figure 3:
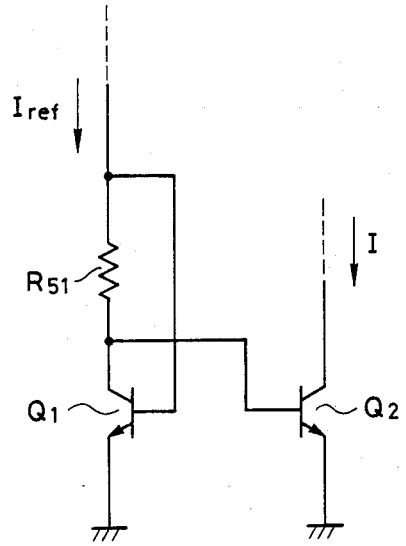
FIG. 3 (PRIOR ART)

One embodiment of the present invention will be described hereunder according to FIG. 1. In FIG. 1, Z1 denotes an impedance element carrying non-linear characteristics, and F11, F12, F13 and F14 denote field effect transistors.

F11 is FET which provides an input reference current $I_{ref}$ flow, while F12 to F14 are FETs which provide output currents $I_2$ to $I_4$ flow respectively. One end of Z1 is connected to the gate of F11, and the other end of Z1 to the drain of F11 and the gates of F12 to F14, while the source of F11 and F12 to F14 are connected to ground potential points. The respective sources of F11 and F12 to F14 can also be connected to the ground potential points through the intermediary of linear resistances.

Now, it is assumed that Z1 is a non-linear element and that a potential difference arising between both ends of Z1 is expressed by $\alpha I_{ref}^{n}+\beta$. If an effect of drain conductance is ignored, on the occasion, $I_{ref}$ can be expressed by $$I_{ref}=K_1(V_{gs1}-V_{th1})^2 \quad (1).$$

In this equation, $K_1$ denotes mutual conductance of F11, and $V_{th1}$ denotes a threshold voltage of F11. From the equation (1)

$$V_{gs1}=\sqrt{\frac{I_{ref}}{K_1}}+V_{th1}. \quad (2)$$

If a current flowing through F12 is denoted by $I_2$, on the other hand, the following equation is established in the same way.

$$V_{gs2}=\sqrt{\frac{I_2}{K_1}}+V_{th2}. \quad (3)$$

Herein $K_2$ denotes the mutual conductance of F12, and $V_{th2}$ a threshold voltage of F12. Furthermore, the relationship $$V_{gs1}=V_{gs2}+(\alpha I_{ref}^{n}+\beta) \quad (4)$$

is established, and therefore, if $V_{th1}=V_{th2}$, $$\sqrt{\frac{I_{ref}}{K_1}}=\sqrt{\frac{I_2}{K_2}}+\alpha I_{ref}^{n}+\beta. \quad (5)$$

Thus, the following equation is obtained.

$$I_2=K_2\left(\sqrt{\frac{I_{ref}}{K_1}}-\alpha I_{ref}^{n}-\beta\right)^2 \quad (6)$$

If a value of $I_{ref}$ whereat $(dI_2/dI_{ref})=0$ is calculated from the equation (6), $$I_{ref}^{n-\frac{1}{2}}=\frac{1}{2n\alpha\sqrt{K_1}}. \quad (7)$$

In the case when FETs F11 and F12 to F14 of FIG. 1 are Schottky barrier type field effect transistors formed on a GaAs substrate, a gate current comes to flow from gate electrodes into source electrodes or drain electrodes when a gate voltage exceeds 0.6 V. When it is 0.6 V or below, however, the input impedance of the gate electrodes is very large, and then the construction of FIG. 1 can be realized. Although the gate voltage, i.e. $V_{gs2}$ of F12 to F14 needs to be 0.6 V or below in this case, the necessity is met constantly by setting the gate voltage $V_{gs1}$ of F11 at 0.6 V or below.

Figure 4:
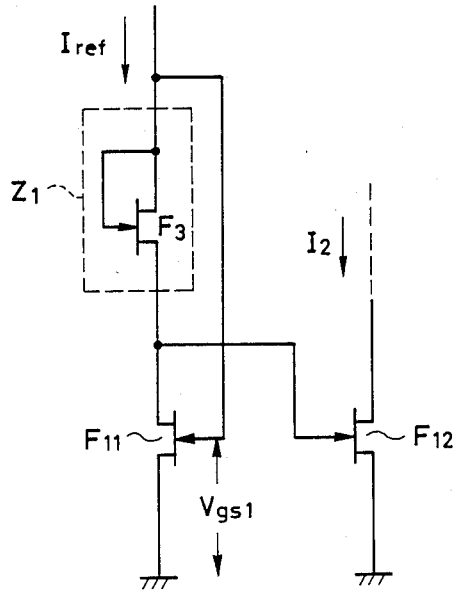
FIG. 4 is a circuit diagram of a constant current circuit according to a concrete embodiment of the present invention.
Figure 5A:
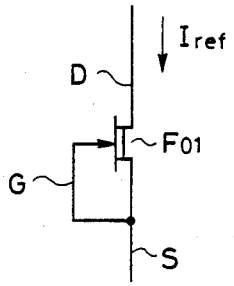
FIG. 5 (*a*) to (*g*) show other concrete means to realize a non-linear impedance element of FIG. 1.
Figure 5B:
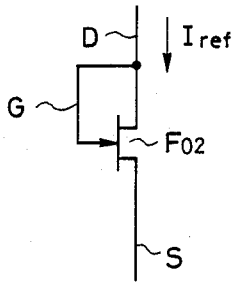
Figure 5C:
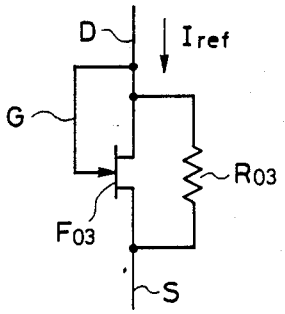
Figure 5D:
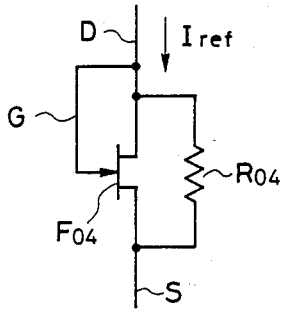
Figure 5E:
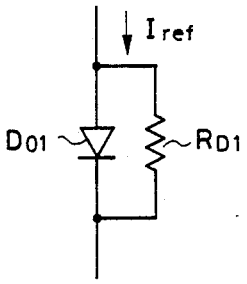
Figure 5F:
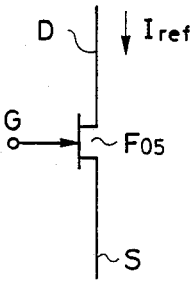
Figure 5G:
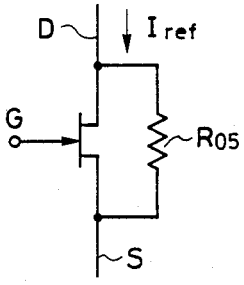

FIG. 4 is a circuit diagram of a constant current circuit according to a concrete embodiment of the present invention, and an impedance element Z1 carrying nonlinear characteristics consists of a field effect transistor F3 the drain and the gate of which are connected together by short-circuiting.

If the mutual conductances of FETs F11, F12 and F3 are denoted by $K_l$, $K_2$ and $K_3$, the gate-source voltages thereof by $V_{gs1}$, $V_{gs2}$ and $V_{gs3}$, and the threshold voltages thereof by $V_{th1}$, $V_{th2}$ $V_{th3}$, $$I_{ref}=K_1(V_{gs1}-V_{th1})^2=K_3(V_{gs3}-V_{th3})^2 \quad (8)$$

$$I_2=K_2(V_{gs2}-V_{th2})^2 \quad (9)$$

$$V_{gs2}=V_{gs1}-V_{gs3} \quad (10)$$

From the above equations (8), (9) and (10), the following equation is obtained.

$$I_2=K_2\left(\sqrt{\frac{I_{ref}}{K_1}}-\sqrt{\frac{I_{ref}}{K_3}}+V_{th1}-V_{th2}-V_{th3}\right)^2 \quad (11)$$

The condition of $(dI_2/dI_{ref})=0$ is $K_1=K_3$. This condition can be realized easily by forming FETs F11 and F3 at the same time and under the same manufacturing conditions in the same integrated circuit chip.

Besides, it can be seen that the aforesaid condition of $K_1=K_3$ corresponds to the case of $n=\frac{1}{2}$ and $\alpha=1\sqrt{/k_3}$ in the above equation (7).

Moreover, it is necessary to set the relationship of $V_{th1}-V_{th2}-V_{th3}\neq 0$ for realizing $I_2\neq 0$ under the condition of $K_1=K_3$. For this purpose, it is preferable to set any two of $V_{th1}$, $V_{th2}$ and $V_{th3}$ (e.g. $V_{th2}$ and $V_{th3}$) to be equal to each other and to set the remaining one (e.g. $V_{th1}$) at a value not being zero. It is effective, for this purpose, to form FETs F11 and F3 at the same time and under the same manufacturing conditions. High-precision control of the threshold voltage $V_{th2}$ by ion implanation of impurities into a channel region of FET F2 is effective to this end.

FIG. 5 (*a*) to (*g*) show other concrete means to realize the non-linear impedance element of FIG. 1. F01 to F06 denote field effect transistors, D, G and S the respective drains, gates and sources thereof, R03 to R05 linear resistances, and D01 a diode.

F01 in FIG. 5 (*a*) is FET an of a normally-ON type (depletion mode). In FIG. 5 (*f*) and (*g*), a fixed bias voltage is impressed on the gates G of F05 and F06.

The FET described above may be an FET other than of a Schottky junction type, for example namely, an HEMT element or MOS-type FET. Besides, a constant current constituent element may be constructed on other than the GaAs substrate, on an Si substrate, for instance.

Figure 6:
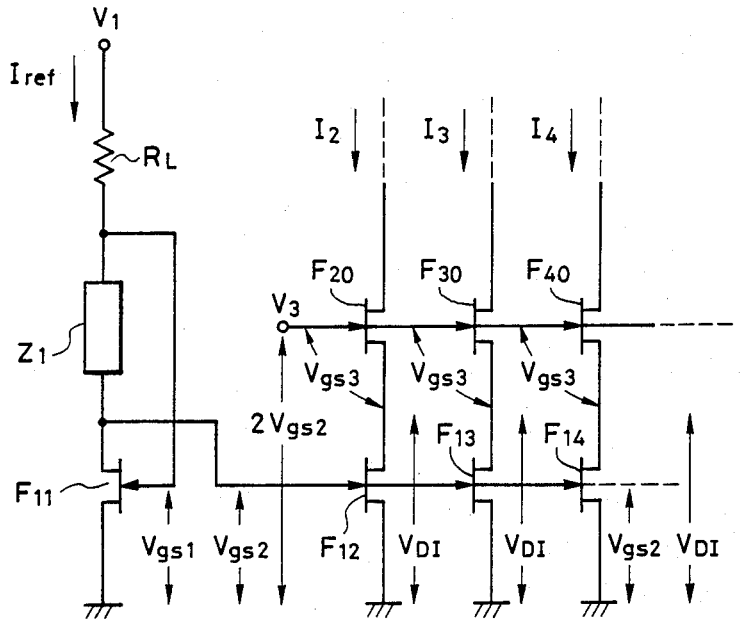
FIGS. 6 and 7 show constant current circuits according to improved embodiments.

FIG. 6 shows a circuit wherein the sources of FETs F20 to F40 are connected to the drains of FETs F12 to F14 of FIG. 1 respectively and a fixed bias $V_3$ is impressed on the gates of FETs F20 to F40. Consequently, the drain voltage of FETs F12 to F14 is stabilized, and thereby output currents $I_2$ to $I_4$ are stabilized.

Figure 7:
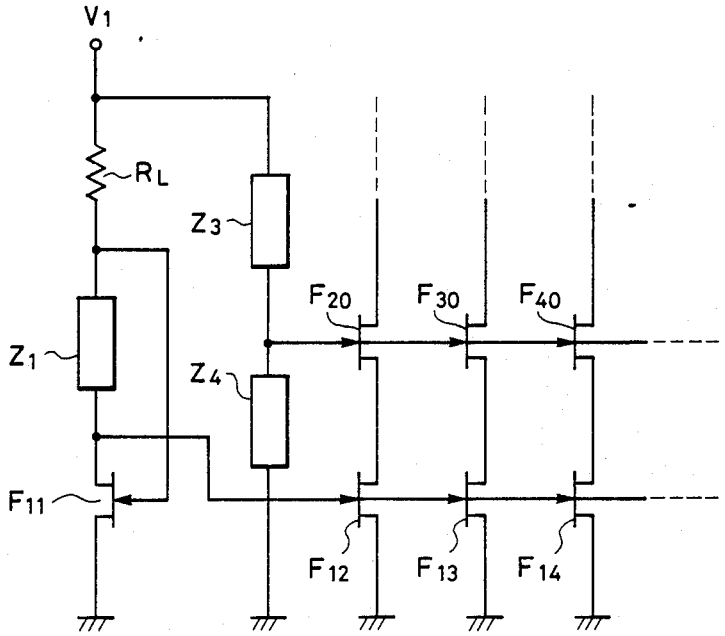

FIG. 7 is an illustration of one embodiment concerned with a case wherein V3 in FIG. 6 is generated by a power source V1, and shows a method wherein the potential of V1 is divided by impedance elements Z3 and Z4 and supplied. Z3 and Z4 can be constructed of resistance elements or the like.

According to the present invention, as described above, an output current can be maintained at a prescribed value irrespective of wide-range variation of an input reference current, in a constant current circuit using FET as a basic element.

What is claimed is:

1. A constant current circuit comprising:

(1) a first field effect transistor which provides an input current flow through the drain-source channel thereof;

(2) an impedance element having a first end which is supplied with said input current and which is connected to the gate of said first field effect transistor and having a second end coupled to the drain of said first field effect transistor; and (3) a second field effect transistor having a gate which is connected to a common node of said second end of said impedance element and said drain of said first field effect transistor, so that an output current flows through the drain-source channel of said second field effect transistor, wherein, when said input current is denoted by $I_{ref}$, said impedance element has non-linear voltage-current characteristics generating a voltage drop containing at least a component of $\alpha I_{ref}n(n\neq 1)$, and wherein, when the conductance of said first field effect transistor is denoted by K, values of said parameters $\alpha$, $I_{ref}$, n and K are so set as to substantially satisfy the following equation:

$$I_{ref}^{n-\frac{1}{2}} = \frac{1}{2n\alpha\sqrt{K}}.$$

2. A constant current circuit according to claim 1, wherein are aforesaid first and second field effect transistors are schottky barrier type field effect transistors.

3. A constant current circuit according to claim 2, wherein the aforesaid first and second field effect transistors are composed of compound semiconductors.

4. A constant current circuit comprising:

(1) a first field effect transistor which provides an input current flow through the drain-source channel thereof;

(2) an impedance element having a first end which is supplied with said input current and which is connected to the gate of said first field effect transistor and having a second end coupled to the drain of said first effect transistor; and (3) a second field effect transistor having a gate which is connected to a common node of said second end of said impedance element and said drain of said first field effect transistor, so that an output current flows through the drain-source channel of said second field effect transistor, wherein said impedance element is formed of a third field effect transistor, the drain and the source of this third field effect transistor are connected to said first end and said second end respectively, and the mutual conductance of the first field effect transistor and the mutual conductance of said third field effect transistor are set in a prescribed relationship with each other, so that said output current is maintained at a substantially definite value irrespective of a predetermined relatively wide-range variation of said input current, and wherein said gate of said third field effect transistor is connected to said drain of said third field effect transistor, and said mutual conductance of said first field effect transistor is set at a value being equal substantially to that of said mutual conductance of said third field effect transistor.

5. A constant current circuit according to claim 4, wherein when the threshold value of the aforesaid first field effect transistor is denoted by $V_{th1}$, the threshold value of the aforesaid second field effect transistor by $V_{th2}$ and the threshold value of said third field effect transistor by $V_{th3}$, these threshold values are set in the following relationship:

$$V_{th1}-V_{th2}-V_{th3}\neq 0.$$

* * * * *